US010884441B2

(12) United States Patent
Sakaguchi

(10) Patent No.: US 10,884,441 B2
(45) Date of Patent: Jan. 5, 2021

(54) VOLTAGE REGULATOR

(71) Applicant: ABLIC Inc., Chiba (JP)

(72) Inventor: Kaoru Sakaguchi, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/279,492

(22) Filed: Feb. 19, 2019

(65) Prior Publication Data

US 2019/0294189 A1 Sep. 26, 2019

(30) Foreign Application Priority Data

Mar. 22, 2018 (JP) ..... 2018-054154

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ... G05F 1/00; G05F 1/10; G05F 1/571; G05F 1/565; G05F 1/575; G05F 1/56; G05F 1/468; G05F 1/561; G05F 1/59; G05F 1/461; G05F 1/462; G05F 1/569; H02M 1/32; H02M 1/08
See application file for complete search history.

(56) References Cited

U.S. PATENT DOCUMENTS 6,608,520 B1 * 8/2003 Miyazaki ..... G05F 1/575 327/540
2004/0113595 A1 * 6/2004 Sugiura ..... G05F 1/575 323/273
2013/0193939 A1 * 8/2013 Sakaguchi ..... G05F 1/5735 323/277
2014/0354249 A1 * 12/2014 Kurozo ..... G05F 1/575 323/271
2015/0177752 A1 * 6/2015 Nakashimo ..... G05F 1/10 323/265
2015/0214838 A1 * 7/2015 Tomioka ..... G05F 1/56 323/282
2015/0220096 A1 * 8/2015 Luff ..... G02F 1/1368 327/109
2015/0244260 A1 * 8/2015 Xu ..... G05F 1/561 315/209 R
2015/0378379 A1 * 12/2015 Bhattad ..... G05F 1/575 323/280
2016/0105113 A1 4/2016 Tsuzaki et al.
(Continued)

FOREIGN PATENT DOCUMENTS

JP 2015-7903 A 1/2015

*Primary Examiner* — Gustavo A Rosario-Benitez
(74) *Attorney, Agent, or Firm* — Brinks, Gilson & Lione

(57) ABSTRACT

A voltage regulator includes an error amplifier which receives a feedback voltage and a reference voltage, an amplifier circuit which receives an output voltage of the error amplifier and controls a gate of an output transistor by a first output voltage, and a non-regulation detection circuit which detects a non-regulation state of the voltage regulator based on a second output voltage of the amplifier circuit. The amplifier circuit includes a first transistor receiving the output voltage of the error amplifier at a gate of the first transistor, and a second transistor connected to a drain of the first transistor, and provides the second output voltage based on a gate-source voltage of the second transistor.

10 Claims, 3 Drawing Sheets

(56) References Cited

U.S. PATENT DOCUMENTS

| | | | | |
|---|---|---|---|---|
| 2017/0199537 | A1* | 7/2017 | Duong | G05F 1/575 |
| 2019/0146531 | A1* | 5/2019 | Yung | G05F 1/563 363/21.01 |

* cited by examiner

VOLTAGE REGULATOR

RELATED APPLICATIONS

This application claims priority under 35 U.S.C. § 119 to Japanese Patent Application No. 2018-054154 filed on Mar. 22, 2018, the entire content of which is hereby incorporated by reference.

BACKGROUND OF THE INVENTION

1. Field of the Invention

The present invention relates to a voltage regulator.

2. Description of the Related Art

A voltage regulator includes an overshoot suppression circuit which suppresses an overshoot of an output voltage thereof. The overshoot of the output voltage is liable to occur when the output voltage of the voltage regulator is lower than a prescribed output voltage, i.e., in a non-regulation state.

Thus, the overshoot suppression circuit has a non-regulation detection circuit constructed from a comparator and suppresses the overshoot when the non-regulation detection circuit detects the non-regulation state (refer to, for example, Japanese Patent Application Laid-Open No. 2015-7903).

SUMMARY OF THE INVENTION

However, when an attempt is made to realize a high breakdown-voltage voltage regulator by an integrated circuit in a CMOS manufacturing process by using the technique disclosed in Japanese Patent Application Laid-Open No. 2015-7903, the following points should be examined.

When a power supply voltage swings from a low voltage to a high voltage, a gate voltage of an output transistor swings in almost the same range as that of the power supply voltage. Thus, a gate oxide film of an input transistor for a comparator constructing a non-regulation detection circuit is required to have a high breakdown voltage as high as the power supply voltage. Since a high breakdown voltage MOS transistor having a thick gate oxide film shows larger characteristic variation than a low breakdown voltage MOS transistor having a thin gate oxide film, the characteristic of the non-regulation detection circuit is liable to vary. Further, when the low breakdown voltage MOS transistor having a thin gate oxide film and the high breakdown voltage MOS transistor having a thick gate oxide film are made on the same substrate, the number of process steps in the CMOS manufacturing process increases, thereby increasing a manufacturing cost.

The present invention aims to provide a voltage regulator low in manufacturing cost and small in variation of the characteristics of a detection function, while having a high breakdown voltage.

A voltage regulator according to one aspect of the present invention includes an error amplifier which receives a feedback voltage and a reference voltage, an amplifier circuit which receives an output voltage of the error amplifier and controls a gate of an output transistor by a first output voltage, and a non-regulation detection circuit which detects a non-regulation state of the voltage regulator based on a second output voltage provided from the amplifier circuit. The amplifier circuit includes a first transistor having a gate to which the output voltage of the error amplifier is supplied, and a second transistor connected to a drain of the first transistor, and provides the second output voltage based on a gate-source voltage of the second transistor.

According to a voltage regulator of the present invention, since an input voltage of a comparator for sensing a gate voltage of the output transistor is configured to have a limitation caused by a reference voltage, a non-regulation detection circuit can be constructed only from a low breakdown voltage MOS transistor having a thin gate oxide film so that characteristic variation can be reduced. Further, it is possible to reduce a manufacturing cost by omitting the number of process steps for a high breakdown voltage MOS transistor.

DETAILED DESCRIPTION OF THE PREFERRED EMBODIMENTS

Embodiments of the present invention will hereinafter be described with reference to the accompanying drawings.

Figure 1:
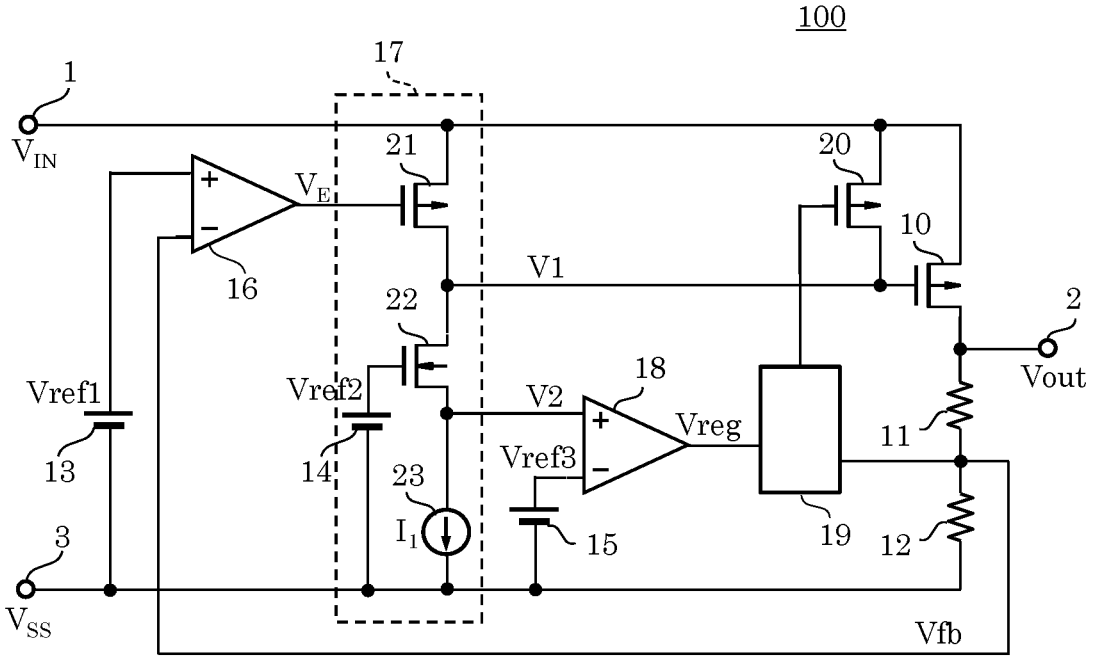
FIG. 1 is a circuit diagram illustrating a voltage regulator according to an embodiment of the present invention.

FIG. 1 is a circuit diagram illustrating a voltage regulator 100 according to an embodiment.

The voltage regulator 100 includes a voltage input terminal 1, a voltage output terminal 2, a ground terminal 3, an output transistor 10, resistors 11 and 12 forming a feedback circuit, reference voltage circuits 13 and 15, an error amplifier 16, an amplifier circuit 17, a non-regulation detection circuit 18, and an overshoot detection circuit 19 and a PMOS transistor 20 which form an overshoot suppression circuit. The amplifier circuit 17 includes a PMOS transistor 21, an NMOS transistor 22, a constant current source 23, and a reference voltage circuit 14.

A description will be made of connections of the components in the voltage regulator 100.

The output transistor 10 has a source connected to the voltage input terminal 1, a drain connected to the voltage output terminal 2, and a gate connected to the first output of the amplifier circuit 17. The resistor 11 has one terminal connected to the voltage output terminal 2, and the other terminal connected to one terminal of the resistor 12. The resistor 12 has the other terminal connected to the ground terminal 3. A connecting point of the resistor 11 and the resistor 12 which provides a feedback voltage Vfb is connected to an inversion input terminal of the error amplifier 16 and an input terminal of the overshoot detection circuit 19. The error amplifier 16 has a non-inversion input terminal to which an output of the reference voltage circuit 13 is connected, and an output terminal connected to a gate of the PMOS transistor 21 which is an input to the amplifier circuit 17.

The PMOS transistor 21 has a source connected to the voltage input terminal 1, and a drain being a first output of the amplifier circuit 17 and being connected to a drain of the NMOS transistor 22. The NMOS transistor 22 has a source being a second output of the amplifier circuit 17 and being connected to the ground terminal 3 through the constant current source 23, and a gate connected to an output of the reference voltage circuit 14. The non-regulation detection circuit 18 has a non-inversion input terminal to which the second output of the amplifier circuit 17 is connected, an inversion input terminal to which an output of the reference voltage circuit 15 is connected, and an output terminal connected to the input terminal of the overshoot detection circuit 19. The overshoot detection circuit 19 has an output connected to a gate of the PMOS transistor 20. The PMOS transistor 20 has a source connected to the voltage input terminal 1, and a drain connected to the gate of the output transistor 10.

The operation of the voltage regulator 100 having an above configuration will be described below.

The reference voltage circuit 13 provides a reference voltage Vref1 based on a ground voltage Vss of the ground terminal 3. The reference voltage circuit 14 provides a reference voltage Vref2 based on the ground voltage Vss of the ground terminal 3. The reference voltage circuit 15 provides a reference voltage Vref3 based on the ground voltage Vss of the ground terminal 3.

In a regulation state in which an input voltage Vin to the voltage input terminal 1 of the voltage regulator 100 is sufficiently high, an output voltage Vout at the voltage output terminal 2 is controlled to a desired output voltage determined from the reference voltage Vref1 by the resistance ratio between the resistors 11 and 12 of the feedback circuit. At this time, the error amplifier 16 and the amplifier circuit 17 control a gate voltage of the output transistor 10 in such a manner that the feedback voltage Vfb and the reference voltage Vref1 coincide. The amplifier circuit 17 has a gain and amplifies an output voltage $V_E$ from the error amplifier 16, and provides a voltage V1 being the first output voltage to the gate of the output transistor 10. The NMOS transistor 22 in the amplifier circuit 17 is biased by a current $I_1$ of the constant current source 23 and provides a voltage V2 being a second output voltage from the source thereof. In the regulation state, the voltage V1 becomes a voltage lowered by a gate-source voltage of the output transistor 10 from the input voltage Vin. The voltage V2 becomes a voltage lowered by a gate-source voltage of the NMOS transistor 22 from the reference voltage Vref2. The reference voltage Vref3 is set lower than the voltage V2 in the regulation state.

When the voltage V2 is higher than the reference voltage Vref3, the non-regulation detection circuit 18 provides a signal Vreg of an H level which indicates the regulation state. When the signal Vreg is at the H level, the overshoot detection circuit 19 controls a gate voltage of the PMOS transistor 20 in such a manner that the PMOS transistor 20 turns off regardless of the feedback voltage Vfb.

On the other hand, when the input voltage Vin falls below the prescribed output voltage for the output voltage Vout, the voltage regulator 100 enters a non-regulation state. Since the feedback voltage Vfb is lower than the reference voltage Vref1, the output voltage $V_E$ of the error amplifier 16 becomes high, and hence the PMOS transistor 21 turns off to pull down the voltage V1 to near the ground voltage Vss. At this time, since the NMOS transistor 22 reaches a non-saturated state, the voltage V2 is pulled down to near the ground voltage Vss and thereby becomes lower than the reference voltage Vref3. When the voltage V2 is lower than the reference voltage Vref3, the non-regulation detection circuit 18 provides a signal Vreg of an L level which indicates the non-regulation state.

Receiving the signal Vreg of the L level, the overshoot detection circuit 19 enables overshoot detection of the output voltage Vout. From a rise in the feedback voltage Vfb the overshoot detection circuit 19 detects an overshoot of the output voltage Vout caused by variation of the input voltage Vin. When the overshoot detection circuit 19 detects the overshoot, the overshoot detection circuit 19 provides a signal to turn on the PMOS transistor 20 to raise the on resistance of the output transistor 10, thereby suppressing the overshoot of the output voltage Vout.

As described above, the voltage V2 being the input voltage of the non-inversion input terminal of the non-regulation detection circuit 18 is suppressed to the voltage lower than the reference voltage Vref2 regardless of the state of the voltage regulator 100. Thus, even when the input voltage Vin is a high voltage, and the voltage V1 of the gate of the output transistor swings to the high voltage, the voltage V2 of the non-inversion input terminal of the non-regulation detection circuit 18 does not reach the high voltage. The input transistor of the comparator forming the non-regulation detection circuit can hence be constituted from a low breakdown voltage MOS transistor having a thin gate oxide film.

Since the low breakdown voltage MOS transistor having a thin gate oxide film shows relatively small characteristic variation, the non-regulation detection circuit 18 is also capable of reducing variation in the characteristic. Further, since there is no need of a high breakdown voltage MOS transistor having a thick gate oxide film, it is possible to omit the number of process steps and thereby reduce a manufacturing cost.

Figure 2:
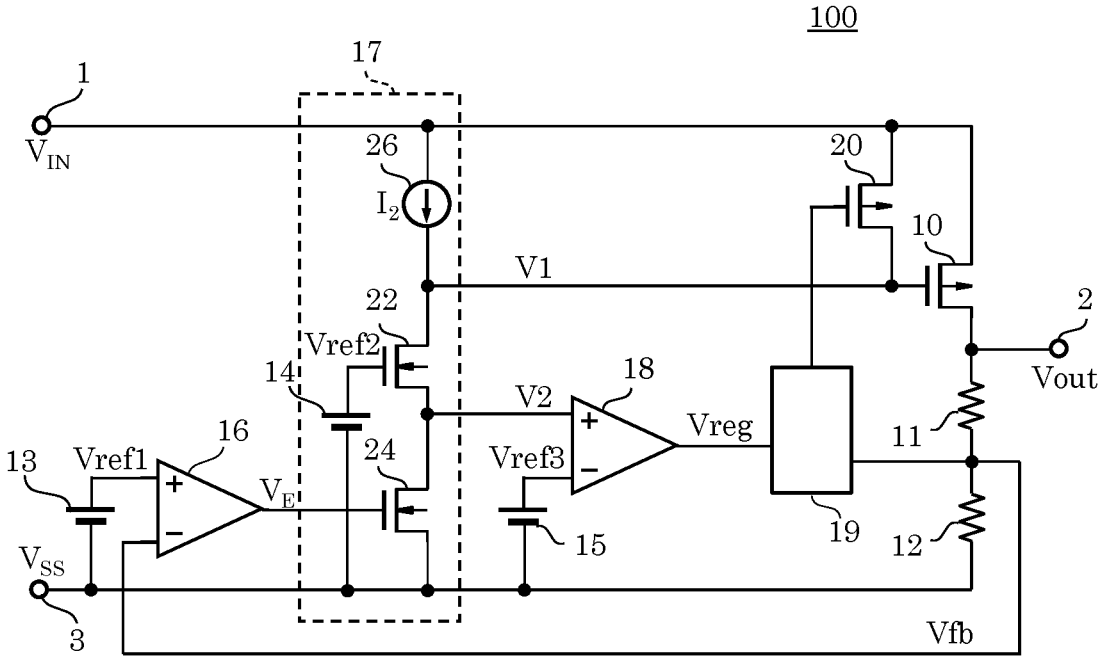
FIG. 2 is a circuit diagram illustrating another example of the voltage regulator according to the embodiment.

FIG. 2 is a circuit diagram illustrating another example of the voltage regulator according to the embodiment.

The voltage regulator 100 illustrated in FIG. 2 includes an NMOS transistor 24 in place of the PMOS transistor 21 of the amplifier circuit 17 in FIG. 1. An amplifier circuit 17 has an NMOS transistor 24, an NMOS transistor 22, a constant current source 26, and a reference voltage circuit 14. Incidentally, the same components as those in the voltage regulator 100 illustrated in FIG. 1 are denoted by the same reference numerals, and their dual description will be omitted as appropriate.

The NMOS transistor 24 has a source connected to a ground terminal 3, and a drain being a second output of the amplifier circuit 17 and connected to a source of the NMOS transistor 22. The NMOS transistor 22 has a gate connected to an output of the reference voltage circuit 14, and a drain being a first output of the amplifier circuit 17 and connected to a voltage input terminal 1 through the constant current source 26.

In the regulation state of the voltage regulator, the NMOS transistor 22 is biased by a current $I_2$ of the constant current source 26 and thereby provides a voltage V2 lowered by a gate-source voltage of the NMOS transistor 22 from a reference voltage Vref2. Also, in a non-regulation state thereof, the NMOS transistor 22 becomes a non-saturated state, so that the voltage V2 is pulled down to near a ground voltage Vss.

Similar to the amplifier circuit 17 of the voltage regulator 100 illustrated in FIG. 1, the amplifier circuit 17 constructed as above is capable of suppressing the voltage V2 being an input voltage of a non-inversion input terminal of a non-regulation detection circuit 18 to a voltage lower than the reference voltage Vref2 regardless of the state of the voltage regulator 100. The voltage regulator 100 illustrated in FIG. 2 is hence capable of obtaining an effect similar to that of the voltage regulator 100 illustrated in FIG. 1.

Figure 3:
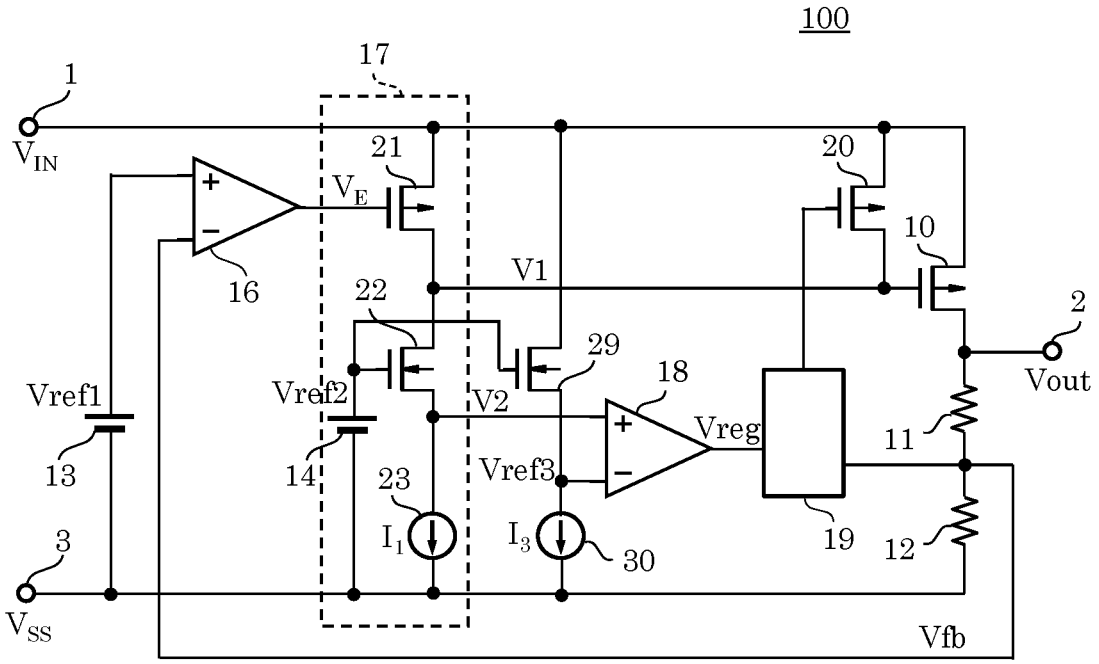
FIG. 3 is a circuit diagram illustrating a further example of the voltage regulator according to the embodiment.

FIG. 3 is a circuit diagram illustrating a further example of the voltage regulator according to the embodiment. Incidentally, the same components as those in the voltage regulator illustrated in FIG. 1 are denoted by the same reference numerals, and their dual description will be omitted as appropriate.

The voltage regulator 100 illustrated in FIG. 3 includes an NMOS transistor 29 and a constant current source 30 in place of the reference voltage circuit 15 of the voltage regulator 100 illustrated in FIG. 1 and provides a reference voltage Vref3 from a connecting point of the NMOS transistor 29 and the constant current source 30.

The NMOS transistor 29 has a source connected to a ground terminal 3 through the constant current source 30, a gate to which an output of a reference voltage circuit 14 is connected, and a drain connected to a voltage input terminal 1.

The NMOS transistor 29 is biased by a current $I_3$ of the constant current source 30 and provides a reference voltage Vref3 from the source thereof. The reference voltage Vref3 becomes a voltage lowered by a gate-source voltage of the NMOS transistor 29 from a reference voltage Vref2.

Reducing the reference voltage Vref3 lower than a voltage V2 in a regulation state of the voltage regulator can easily be realized by making the current $I_3$ larger than a current $I_1$, reducing W/L aspect ratio of the NMOS transistor 29 smaller than W/L aspect ratio of an NMOS transistor 22, making an ideal threshold voltage of the NMOS transistor 29 larger than an ideal threshold voltage of the NMOS transistor 22, or combining these measures.

Using these measures, even if there is variation in device characteristics, almost no variation occurs in a high-low relation between the reference voltage Vref3 and the voltage V2 because the NMOS transistor 22 and the NMOS transistor 29, and a constant current source 23 and the constant current source 30 fluctuate in the same manner.

The voltage regulator 100 of FIG. 3 constructed as above brings about an effect in that since the variation in the device characteristics can be absorbed, the reference voltage Vref3 whose variation in the high-low relation with the voltage V2 is little can be simply obtained.

Although the embodiments of the present invention have been described above, the present invention is not limited to the above embodiments. It is needless to say that various changes can be made thereto within the scope not departing from the gist of the present invention.

For example, the reference voltage circuit 13 and the reference voltage circuit 14 may be made common in a range in which the operation mentioned in the description of each embodiment is established. Also, for example, a depletion type NMOS transistor whose gate is connected to the ground terminal 3 may be used instead of the reference voltage circuit 14 and the NMOS transistor 22 as a second amplifier circuit. In this case, the voltage V2 in the regulation state becomes a voltage set high by an absolute value of a threshold voltage of the depletion type NMOS transistor, i.e., an absolute value of its gate-source voltage from the ground voltage Vss.

Further, although the voltage regulator according to the present embodiment has been described using the circuit of controlling the overshoot detection circuit by the output signal of the non-regulation detection circuit, the output signal of the non-regulation detection circuit may be used in any circuit.

What is claimed is:

1. A voltage regulator, comprising: a feedback circuit configured to provide a feedback voltage based on an output voltage provided from an output transistor; an error amplifier configured to receive the feedback voltage and a reference voltage; an amplifier circuit configured to receive an output voltage from the error amplifier, amplify the output voltage from the error amplifier to generate a first output voltage, and control a gate of the output transistor with the first output voltage; and a non-regulation detection circuit configured to detect a non-regulation state of the voltage regulator based on a second output voltage provided from the amplifier circuit, the amplifier circuit comprising a first transistor receiving the output voltage of the error amplifier at a gate of the first transistor, and a second transistor connected to a drain of the first transistor, and providing the second output voltage based on a gate-source voltage of the second transistor, wherein the first output voltage is the voltage at a drain of the second transistor, wherein the amplifier circuit comprises a reference voltage circuit configured to supply a voltage to a gate of the second transistor.

2. The voltage regulator according to claim 1, wherein the amplifier circuit comprises a constant current source configured to bias the second transistor.

3. The voltage regulator according to claim 1, further comprising a second reference voltage circuit having a third transistor whose gate is connected to the gate of the second transistor and a second constant current source configured to bias the third transistor, the second reference voltage circuit being configured to supply a second reference voltage to the non-regulation detection circuit.

4. The voltage regulator according to claim 2, further comprising a second reference voltage circuit having a third transistor whose gate is connected to the gate of the second transistor and a second constant current source configured to bias the third transistor, the second reference voltage circuit being configured to supply a second reference voltage to the non-regulation detection circuit.

5. The voltage regulator according to claim 1, wherein the second transistor comprises an NMOS transistor, and wherein the first transistor comprises a PMOS transistor, wherein the drain of the second transistor is connected to a drain of the first transistor.

6. The voltage regulator according to claim 1, wherein the second transistor comprises an NMOS transistor, and wherein the first transistor comprises an NMOS transistor, wherein a source of the second transistor is connected to a drain of the first transistor.

7. The voltage regulator according to claim 2, wherein the constant current source is connected to a source of the second transistor.

8. The voltage regulator according to claim 7, wherein the second transistor comprises an NMOS transistor, and wherein the first transistor comprises a PMOS transistor, wherein the drain of the second transistor is connected to a drain of the first transistor.

9. The voltage regulator according to claim 2, wherein the constant current source is connected to the drain of the second transistor.

10. The voltage regulator according to claim 9, wherein the second transistor comprises an NMOS transistor, and wherein the first transistor of the amplifier circuit comprises an NMOS transistor, wherein a source of the second transistor is connected to a drain of the first transistor.

* * * * *